United States Patent [19]

Payne

[11] 4,183,305

[45] Jan. 15, 1980

[54] FURNACE SEAL

[75] Inventor: Geoffrey Payne, Rotherham, England

[73] Assignee: British Steel Corporation, London, England

[21] Appl. No.: 881,405

[22] Filed: Feb. 27, 1978

[30] Foreign Application Priority Data

Mar. 8, 1977 [GB] United Kingdom ..... 9670/77

[51] Int. Cl.[2] ..... F23M 7/00

[52] U.S. Cl. ..... 110/173 A; 432/250

[58] Field of Search ..... 110/173 R, 173 A; 432/242, 250

[56] References Cited

U.S. PATENT DOCUMENTS

| | | | |
|---|---|---|---|
| 2,507,360 | 5/1950 | Wicks | 110/173 |
| 3,853,077 | 12/1974 | Malovich | 432/250 |
| 3,854,262 | 12/1974 | Brady | 110/173 |
| 4,097,228 | 6/1978 | Rosling | 110/173 |
| 4,120,641 | 10/1978 | Myles | 432/250 |

*Primary Examiner*—Kenneth W. Sprague

*Attorney, Agent, or Firm*—Bacon & Thomas

[57] ABSTRACT

A peripheral seal for a furnace, e.g. a soaking pit, comprising an elongate rectangular section fibre assembly mountable on the furnace roof or door such that a flat face of the assembly can bear on a mating face of the furnace wall, means being provided for advancing the assembly such that the flat face thereof can be maintained in contact with the wall face whereby to compensate for wear and erosion of the fibre assembly.

11 Claims, 4 Drawing Figures

FURNACE SEAL

This invention relates to furnace seals, and more particularly relates to seals for furnace lids, e.g. soaking pit lids in steelworks; it is an improvement in or modification of the invention in our United Kingdom Patent Application No. 2623/75.

From one aspect, this invention provides a peripheral seal for a furnace closure member comprising an elongate rectangular-section ceramic fibre assembly mountable on the closure member such that a flat face of the assembly can bear on a mating face of the furnace wall, and means for advancing the assembly so that its said face can be maintained in contact with the wall face whereby to compensate for wear and erosion of the fibre assembly.

Preferably the assembly is made from a multiplicity of ceramic fibre pads clamped together along a central supporting rod. The assembly may conveniently be secured to the closure member by tie links at spaced positions along the rod by which the assembly may be advanced. In particular these links may be threaded, and mounted in suspension from the closure member by nuts which may be slackened to advance the assembly. The assembly may be square, or it may be oblong in which case the direction of movement will be along the major axis of the oblong.

The assembly may be located along each side or end wall of the closure member, e.g. a furnace door, or it may conveniently be located along only the end wall of the closure member or 'lid' of a steel works soaking pit at which ingots are removed, the other end wall and/or the sides of the furnace being provided with a sand trough/lid dipper seal or a planar fibre seal.

By having the fibre assembly secured to and dependent from the soaking pit lid it is thus not in a position where it can be damaged by falling debris as would be the case if the fibre seal were provided on the furnace wall or lip. Since the latter is a flat firm area it can readily be swept clear of any such debris so as to present a clean face to the seal assembly each time the lid is raised and lowered again. In addition the seal is not subjected to damage by maintenance personnel during pit repairs or by the ingots themselves as they are withdrawn from the pit.

In order that this invention may be fully understood one embodiment thereof will now be described, by way of example, with reference to the accompanying drawings, in which.

Figure 1:
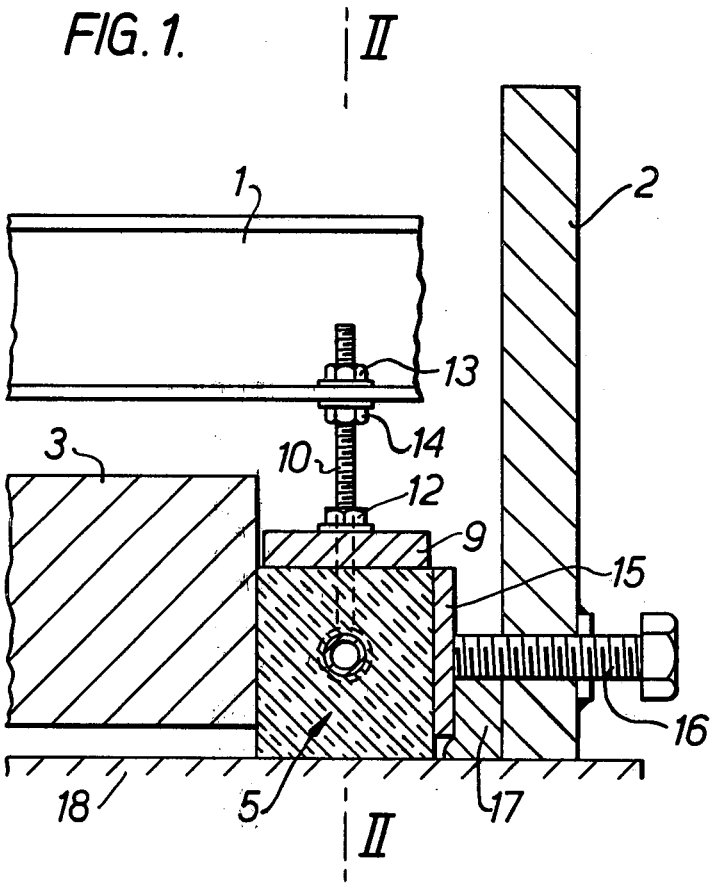
FIG. 1 is a sectional side elevation through part of a soaking pit lid incorporating a seal in accordance with this invention.
Figure 2:
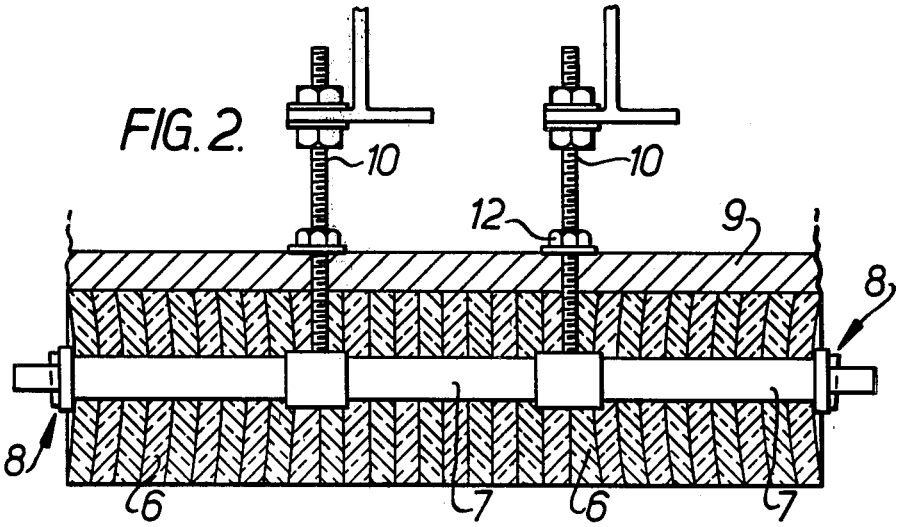
FIG. 2 is a section along II—II in FIG. 1.

Referring now to FIGS. 1 and 2, the roof superstructure of the lid includes a series of girders 1, an end plate 2 and a roof lining 3 which, for example, may comprise a concrete or bricked structure, secured to and dependent from the girders 1.

A ceramic fibre assembly 5 is clamped against the end of the roof lining, the assembly comprising a multiplicity of oblong section fibre pads 6 (FIG. 2) e.g. Kaowool, mounted on a central rod 7 and retained thereon by washers/pins 8. Each assembly (there may be several arranged end-to-end to extend along the end of the lid) is secured to a plate 9 by threaded tie links 10, nuts 12 on these links holding the top side of the pad assembly in tight contact with the underside of the plate.

In turn, the threaded tie links are secured to protruding flanges on the girders 1 by nuts 13, 14.

A further plate 15 extends alongside the whole length of the assemblies and this is firmly biassed by a series of screws 16 in the end plate 2 into contact with the fibre assemblies whereby to compress the latter and retain them firmly in contact with the roof lining. Loose fibre 17 is packed into the gap between the end plate 2 and the plate 15 as an additional measure of sealing.

The soaking pit lid seal is shown in position with the fibre assemblies (and the end plate 2) resting on the upper wall or ledge 18 of the furnace proper. With use, the underside of the fibre becomes worn and the seal is broken. With this invention, upon such wear and erosion occuring, it is simply rectified by advancing the fibre assemblies downwards into contact with the wall 18 again by appropriate adjustment of the nuts 13/14—the plate 15 being slackened off for this purpose.

The fibre assembly shown is oblong in cross-section cheifly to enable the latter to be advanced in this fashion, but this configuration is not an essential feature of this invention. This mode of operation has however the added advantage that when it has worn "square" the assembly may simply be rotated to bring another clean face into contact with the furnace wall, i.e. in the manner described in the aforementioned 'parent' patent application.

Figure 3:
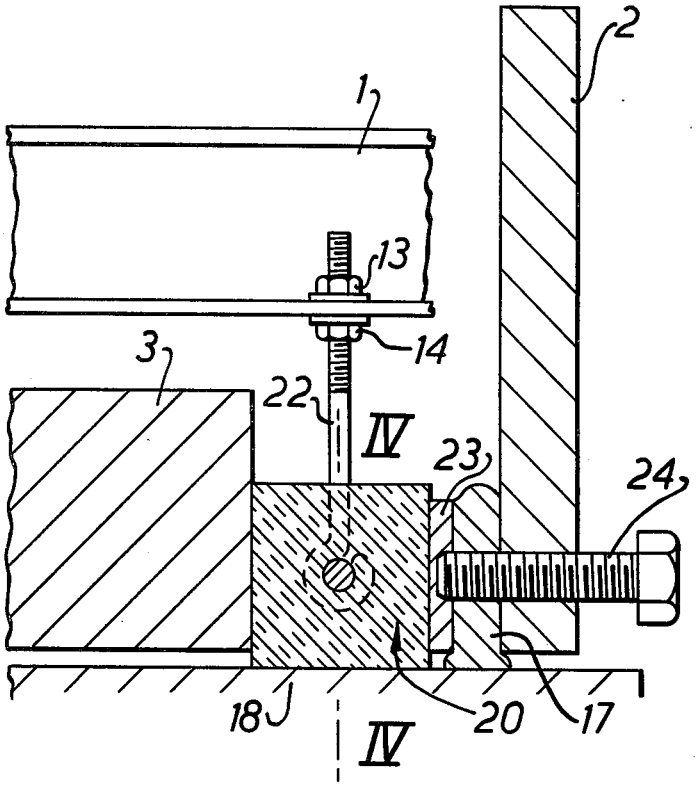
FIG. 3 is a sectional side elevation similar to FIG. 1 but with a square-section assembly.
Figure 4:
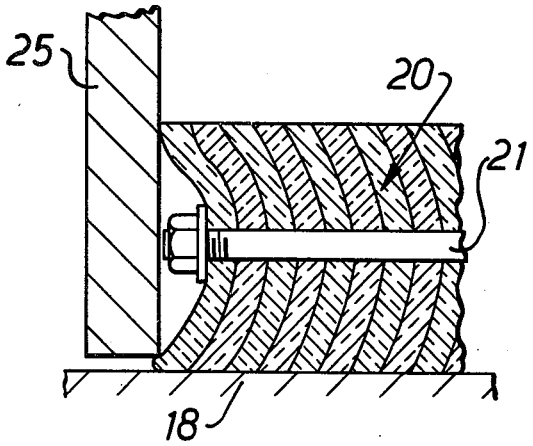
FIG. 4 is a section along IV—IV in FIG. 3.

A sqaure-section fibre assembly is shown in FIGS. 3 and 4. In this arrangement the assembly 20 is again mounted on a central screw-threaded rod (21) but in this instance it is simply suspended by threaded tie links 22 from flanges on the girders 1, there being no 'backing' plate 9 in this embodiment. A tension plate 23 extends alongside the whole length of the assembly and this is firmly biassed by a series of screws 24 whereby to compress the assembly and retain it firmly in contact with the refractory roof lining 3. Loose packing 17 is again provided as an additional sealant. As can be seen from FIG. 4 in particular the axially compressed fibre assembly tends to bulge outwardly to contact the side walls 25 of the roof making a complete seal.

The assembly is advanced downwardly to compensate for wear by adjustment of the nuts 13 and 14 and a clean face of the assembly can be presented to the furnace wall as desired simply by rotation about the rod 21.

Although this invention has been described with reference to the particular embodiments illustrated it is to be understood that various other designs could readily be adopted consistent with the facility of advancing the assembly to cater for wear and erosion. Further, although the arrangement shown envisages the use of a number of separate assemblies to bridge the lid this is not strictly necessary and a single composite construction could alternatively be adopted. Ceramic fibres other than 'Kaowool' could also be used of course, e.g. Saffil, and the fibre assemblies may extend around the whole periphery of the lid instead of selected sides as shown.

We claim:

1. A demountable peripheral seal for sealing an opening between a furnace closure member and a mating furnace wall face, comprising an elongate rectangular-section assembly of ceramic fibre arranged in layers lying in generally parallel planes perpendicular to the length thereof mountable on the closure member and having a flat face arranged to bear on a mating face of the furnace wall when the seal assembly is mounted on a closure member, and means enabling advancement of the assembly perpendicular to its length, whereby the flat face thereof can be maintained in contact with the wall face whereby to compensate for wear and erosion of the fibre assembly.

2. A seal according to claim 1, wherein the assembly comprises a central supporting rod and a multiplicity of discrete fibre pads clamped together alond said rod.

3. A seal according to claim 2, wherein the means enabling advancement of the assembly comprises threaded tie links at spaced positions along the rod and extending between adjacent fibre pads, the assembly being arranged to be secured to the closure member by said tie links.

4. A seal according to claim 3, comprising nuts by which the tie links are mountable in suspension from the closure member, the tie links and the nuts together constituting the said means for enabling advancement of the assembly.

5. A seal according to claim 4, including a closure member having a side wall, said seal assembly mounted on said closure member, and including a plate by which the fibre assembly is retained in contact with said side wall, the plate extending along the length of the assembly and biassed into contact therewith.

6. A seal according to claim 1 or 5, wherein the fibre assembly is oblong in cross-section, the direction of advance being along the major axis of the oblong.

7. A seal according to claim 1 or 5, wherein the fibre assembly is square in cross-section.

8. A fibre seal mountable on the roof of a soaking pit for ingots, said pit including a pit wall having mating faces for said roof, comprising a central supporting rod, an elongate fibre assembly embodying a multiplicity of rectangular-section fibre pads clamped together along said supporting rod and arranged such that a flat face of the pads bears on a mating face of the pit wall, threaded tie links at spaced positions along the length of the rod and extending between adjacent fibre pads, and nuts on said threaded tie links for mounting them on said roof and rotatable to advance the fibre assembly whereby to ensure that the flat face of the pads is maintained in sealing contact with the pit wall to compensate for any wear or erosion of the fibre assembly.

9. A seal according to claim 8, said roof having a side wall, and comprising a plate by which the fibre assembly is retained in contact with the roof side wall, the plate extending along the length of the assembly, and screw-threaded means for biassing the plate into contact with a flat face of the pads adjoining that bearing on the pit wall.

10. A seal according to claim 9, wherein the fibre pads are square in section whereby four different faces may be presented to the pit wall.

11. A seal according to claim 10, mounted along one side only of the roof adjacent that end of the pit from which the ingots are withdrawn.

* * * * *